United States Patent [19]

Benoy

[11] 4,401,865

[45] Aug. 30, 1983

[54] STRIP MATERIAL OUTER TURN PROXIMITY SWITCH DETECTION APPARATUS

[75] Inventor: David C. Benoy, Swanage, England

[73] Assignee: Loewy Robertson Engineering Co. Ltd., Poole, England

[21] Appl. No.: 300,476

[22] Filed: Sep. 9, 1981

[30] Foreign Application Priority Data

Sep. 12, 1980 [GB] United Kingdom ..... 8029532

[51] Int. Cl.[3] ..... B65H 25/14

[52] U.S. Cl. ..... 200/61.13; 200/61.16; 200/61.18

[58] Field of Search ..... 200/61.13–61.18, 200/61.41, 61.42; 340/673, 675, 677

[56] References Cited

U.S. PATENT DOCUMENTS 3,253,269 5/1966 Ratti ..... 200/61.18
3,462,568 8/1969 Smith ..... 200/61.13
3,684,845 8/1972 Palmer ..... 200/61.42 X
3,763,483 10/1973 Urmenyi ..... 200/61.13 X

FOREIGN PATENT DOCUMENTS 1247296 9/1971 United Kingdom .

*Primary Examiner*—James R. Scott
*Attorney, Agent, or Firm*—Schwartz & Weinrieb

[57] ABSTRACT

When it is necessary to detect the position of the end of the outer turn of a coil of strip material, the coil is rotatably supported with its axis substantially horizontal and apparatus for detecting the end comprises a detector assembly including a proximity switch and a projection extending beyond the switch and support means for the assembly such that the proximity switch is spaced from the outer surface of the coil and with the projection nearer to the coil than is the switch and the projection is upstream of the switch with reference to the non-paying out direction of rotation of the coil. When the end of the turn passes from beneath the projection, the switch is actuated.

20 Claims, 3 Drawing Figures

STRIP MATERIAL OUTER TURN PROXIMITY SWITCH DETECTION APPARATUS

FIELD OF THE INVENTION

This invention relates to apparatus for detecting the position of the end of the outer turn of a coil of strip material.

BACKGROUND OF THE INVENTION

During the manufacture of metal strip material, it is often necessary to pay out strip material which has previously been wound into a coil so that the strip material can be further processed such as by passing it, while cold, through the rolls of a rolling mill. Apparatus has been developed for positioning the coil of strip material and for feeding it automatically into the further processing station, which is usually the gap between the rolls of a rolling mill. It is necessary, however, that the coil should be positioned relative to the apparatus for feeding it into the processing station so that the end of the outer turn of the coil is in a predetermined position. To this end it is necessary to detect the position of the end of the outer turn of the coil with a considerable degree of accuracy.

SUMMARY OF THE INVENTION

According to the present invention, apparatus for detecting the position of the end of the outer turn of a coil of strip material rotatably supported with its axis substantially horizontal, comprises a detector assembly including a proximity switch and a projection extending beyond the proximity switch in the operating direction thereof, and means supporting the detector assembly with the proximity switch spaced apart from the outer peripheral surface of the coil in the operating direction of the switch and the projection nearer to the outer peripheral surface than is the proximity switch and with the projection upstream of the proximity switch with reference to the non-paying out direction of rotation of the coil, whereby on rotating the coil in the non-paying out direction the outer end of the coil passes from beneath the projection to actuate the proximity switch.

The detector assembly may include means for urging the outer end of the coil towards the proximity switch after the outer end of the coil passes from beneath the projection. The means may be one or more permanent magnets.

In use, the apparatus is arranged such that either the projection or a wheel on the supporting means engages with the outer peripheral surface of the coil. In either event the proximity switch is positioned downstream of the portion which engages the strip material. As the coil is rotated in the direction opposite to the paying out direction the position of the surface of the coil with respect to the proximity switch remains substantially constant until the outer end of the coil passes from beneath the projection and enters into the vicinity of the proximity switch. The movement of the strip material towards the proximity switch causes the switch to operate and produce an electrical signal which is used to stop the rotation of the coil immediately.

BRIEF DESCRIPTION OF THE DRAWINGS

In order that the invention may be more readily understood it will now be described, by way of example only, with reference to the accompanying drawings in which.

DETAILED DESCRIPTION OF THE ILLUSTRATED EMBODIMENT

Figure 1:
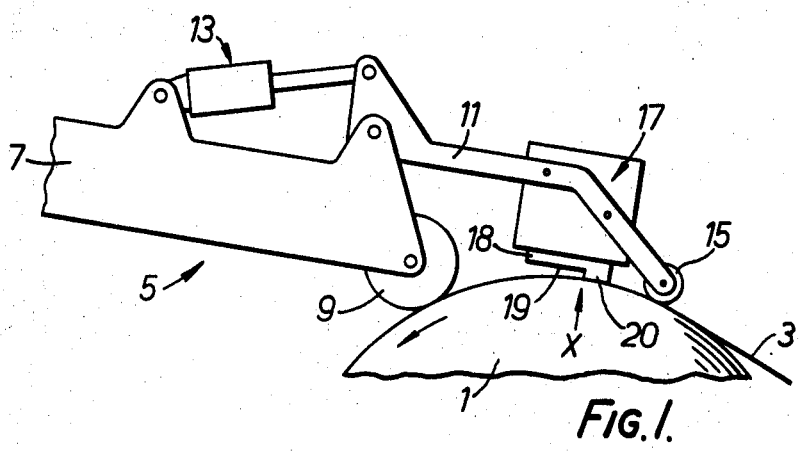
FIG. 1 shows schematically a side elevation of apparatus in accordance with the invention.

Referring now to FIG. 1, a coil of metal strip 1 is supported with its axis substantially horizontal and reference 3 indicates the end of the outer turn of the coil of strip. Apparatus for detecting the position of the end of the outer turn of the coil is indicated generally by reference numeral 5. Frame structure 7 supports a roller 9 arranged with its longitudinal axis parallel to that of the coil and which bears against the outer peripheral surface of the coil. A pair of arms 11 form part of a support assembly and the arms are pivotally mounted at one end to the structure 7 and at the other end the arms support a wheel 15 which is arranged with its longitudinal axis substantially parallel to that of the coil. The support assembly is pivoted about the frame structure 7 by means of a piston-cylinder device 13. In one operating position of the piston-cylinder device 13 the wheel 15 is urged against the outer peripheral surface of the coil, but in the other operating position of the piston-cylinder device the support assembly including the wheel 15 are displaced away from the surface of the coil. The support assembly supports a detector assembly 17. This assembly includes a cylindrical portion containing a piston 18 and the piston protrudes from the underside of the cylindrical portion. The end face 19 of the piston carries a projection 20.

Figure 2:
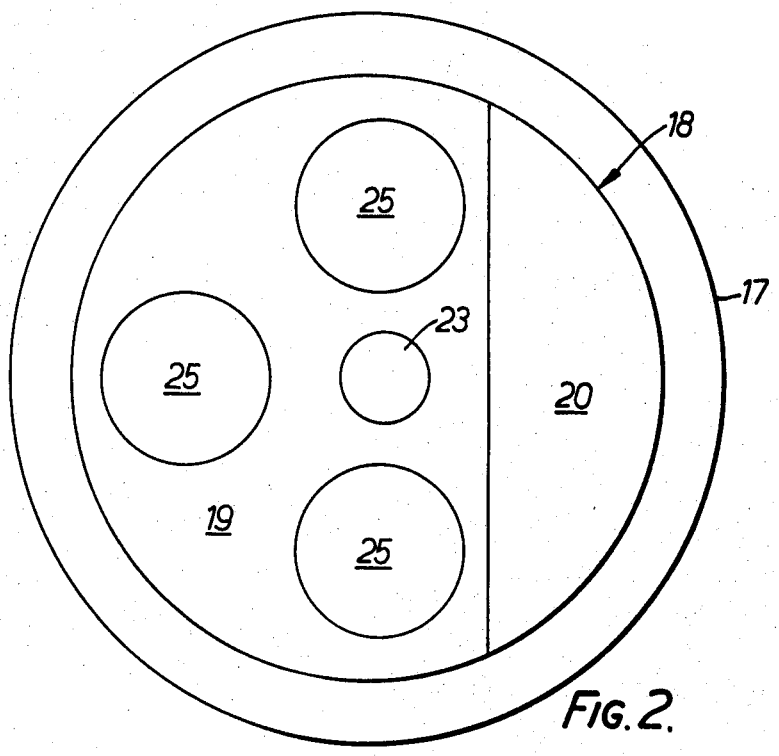
FIG. 2 is a plan in the direction of the arrow X in FIG. 1.

The underside of the piston is shown in more detail in FIG. 2. Centrally of the end face of the piston there is a recess containing a proximity switch 23 and also in the end face there are recesses each accommodating a permanent magnet 25. Referring again to FIG. 1, when the wheel 15 is bearing against the outer peripheral surface of the coil, the projection 20 is very close to, but spaced from the outer peripheral surface. The proximity switch 23 is spaced from the coil and the coil, the end face 19 of the piston the projection 20 form a cavity containing the proximity switch and the magnets. As the coil is rotated in the direction of the arrow, that is in the non-paying out direction, the end 3 of the outer turn passes underneath the wheel 15 but is held close to the surface of the coil by the projection 20. As soon as the end 3 passes from out of engagement with the projection 20, it enters into the cavity. If the material is a springy one, then the end will automatically flip into the cavity and the action of the material coming close to the proximity switch 23 causes the switch to detect the end of the strip material and produce an electrical signal. If however the material is not springy but is a magnetic material, the permanent magnets 25 cause the end of the turn to separate from the coil and to enter into the cavity and to be detected by the proximity switch. If the material of the coil is not magnetic material and it is not springy, then some other means are required for causing the end of the coil to enter into the cavity. To this end, a suction device may be used with one or more suction nozzles located in the lower end face of the piston such that suction applied to these nozzles draws the end of the coil into the cavity to operate the proximity switch. As soon as the switch has been operated to produce an electrical signal, this signal is used to stop the rotation of the coil immediately. The piston-cylinder device 13 is actuated to pivot the support assembly and the detector assembly away from the coil.

If the projection 20 is made of a suitable material, such as a fibre reinforced plastics material, the projection 20 can be allowed to bear against the outer surface of the coil and the wheel 15 can be omitted. The projection 20 rubs against the outer surface of the coil but, because of the material from which it is formed, it does not damage the surface of the coil. As soon as the end of the outer turn of the coil of strip passes from engagement with the projection 20, then it enters into the cavity to operate the proximity switch.

It will be appreciated that when in use, the projection 20 is upstream of the proximity switch and downstream of the wheel 15 (when provided) with respect to the non-paying out direction of rotation of the coil.

Figure 3:
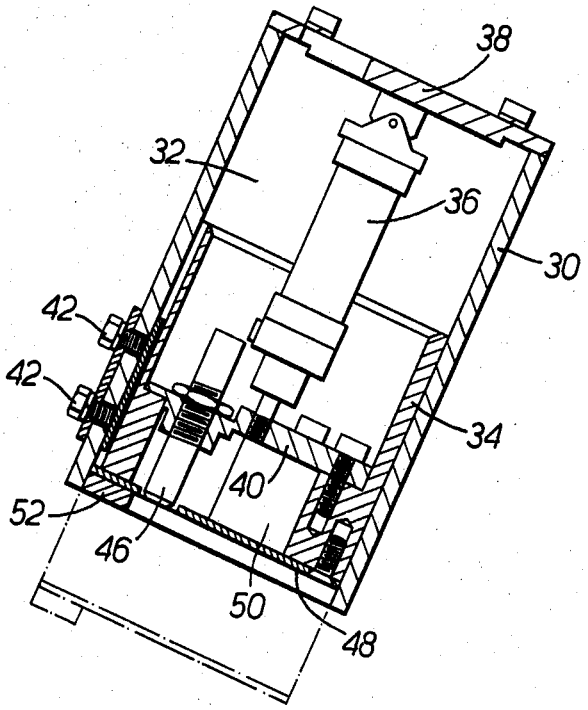
FIG. 3 is a sectional elevation of an alternative detector assembly.

Referring to FIG. 3, an alternative detector assembly comprises a casing 30 defining a cylinder 32 which is open at one end. A piston 34 is displaceable in the cylinder by means of a piston cylinder device 36 which is within the cylinder 32 and is connected to an end wall 38 of the casing opposite the open end of the cylinder and to an internal wall 40 of the piston. A pair of screws 42 project through the side wall of the casing and support a key which projects into the side wall of the piston and prevents rotation thereof.

The wall 40 of the piston supports a proximity switch 46 which extends to the outer end face 48 of the piston and also at least one magnet 50. A pad 52 is bolted to the end face 48 of the piston and serves as a projection extending outwardly of the piston beyond the proximity switch.

The piston is displaceable by the device 36 between a first position, shown in full lines in FIG. 3, where the piston 34 is within the casing 30 and the projection 52 does not extend beyond the open end of the cylinder and a second position, shown in broken lines, which is the operation position and where part of the piston 34 projects from the casing 30.

The advantage of being able to withdraw the piston into the cylinder is that the proximity switch is protected from damage when it is not in use.

Obviously, many modifications and variations of the present invention are possible in light of the above teachings. It is therefore understood that within the scope of the appended claims, the present invention may be practiced otherwise than as specifically described herein.

I claim:

1. Apparatus for detecting the position of the end of the outer turn of a coil of strip material rotatably supported with its axis substantially horizontal, comprising:

a detector assembly including a housing, means mounting a proximity switch upon said housing such that said proximity switch is normally spaced from the peripheral surface of said coil of strip material, and means mounting a projection upon said housing projecting outwardly of said housing so as to be disposed nearer to said peripheral surface of said coil of strip material than said proximity switch, said proximity switch being disposed downstream of said projection as considered in the winding direction of said coil of strip material; and means for causing said end of said outer turn of said coil of strip material to move toward and thereby actuate said proximity switch after said end of said outer turn of said coil of strip material has passed beyond said projection when said outer turn of said coil of strip material is being wound upon said coil of strip material.

2. Apparatus as claimed in claim 1, in which the detector assembly includes means for urging the outer end of the coil towards the proximity switch after the outer end of the coil passes from beneath the projection.

3. Apparatus as claimed in claim 2, in which said means comprises at least one permanent magnet.

4. Apparatus as claimed in claim 1, further comprising:

means supporting said detector assembly including a wheel positioned upstream of the projection and urged into engagement with the outer peripheral surface of the coil.

5. Apparatus as claimed in claim 1, in which the projection is of fibre-reinforced plastics material and the projection engages the outer peripheral surface of the coil.

6. Apparatus as set forth in claim 1, wherein:

said strip material comprises springy metal.

7. Apparatus as set forth in claim 6, wherein:

said means for causing said end of said strip material to move toward said proximity switch comprises the inherent resiliency of said springy metal.

8. Apparatus as set forth in claim 1, wherein:

said strip material comprises magnetic material.

9. Apparatus as set forth in claim 8, wherein:

said means for causing said end of said strip material to move toward said proximity switch comprises magnet means disposed within said detector assembly.

10. Apparatus as set forth in claim 1, wherein said detector assembly further comprises:

a piston;

said projection forming one portion of said piston; and said proximity switch being disposed within a second portion of said piston which is internally stepped or recessed with respect to said one portion of said piston.

11. Apparatus for detecting the position of the end of the outer turn of a coil of strip material rotatably supported with its axis substantially horizontal, comprising:

a frame structure;

a support assembly mounted upon said frame structure;

a detector assembly mounted upon said support assembly and including a housing, means mounting a proximity switch upon said housing such that said proximity switch is normally spaced from the peripheral surface of said coil of strip material, and means mounting a projection upon said housing projecting outwardly of said housing so as to be disposed nearer to said peripheral surface of said coil of strip material than said proximity switch, said proximity switch being disposed downstream of said projection as considered in the winding direction of said coil of strip material; and means for causing said end of said outer turn of said coil of strip material to move toward and thereby actuate said proximity switch after said end of said outer turn of said coil of strip material has passed beyond said projection when said outer turn of said coil of strip material is being wound upon said coil of strip material.

12. Apparatus as set forth in claim 11, wherein:
said detector assembly includes said means for causing said end of said strip material to move toward said proximity switch.

13. Apparatus as set forth in claim 12, wherein:
said means for causing said movement of said end of said strip material to move toward said proximity switch comprises at least one permanent magnet.

14. Apparatus as set forth in claim 11, wherein:
said strip material comprises springy metal.

15. Apparatus as set forth in claim 14, wherein:
said means for causing said end of said strip material to move toward said proximity switch comprises the inherent resiliency of said springy metal.

16. Apparatus as set forth in claim 11, wherein said detector assembly further comprises:
a piston;
said projection forming a first portion of said piston; and
said proximity switch being disposed within a second portion of said piston which is internally stepped or recessed relative to said first portion of said piston.

17. Apparatus for detecting the position of the end of the outer turn of a coil of strip material rotatably supported with its axis substantially horizontal, comprising:
a frame structure including a roller;
a support assembly pivotably mounted upon said frame structure and including wheel means for pivoting said support assembly relative to said frame structure;
a detector assembly mounted upon said support assembly upstream of said frame roller and downstream of said support assembly wheel means, and including a housing, means mounting a proximity switch upon said housing such that said proximity switch is normally spaced from the peripheral surface of said coil of strip material, and means mounting a projection upon said housing projecting outwardly of said housing so as to be disposed nearer to said peripheral surface of said coil of strip material than said proximity switch, said proximity switch being disposed downstream of said projection as considered in the winding direction of said coil of strip material; and
means for causing said end of said outer turn of said coil of strip material to move toward and thereby actuate said proximity switch after said end of said outer turn of said coil of strip material has passed beyond said projection when said outer turn of said coil of strip material is being wound upon said coil of strip material.

18. Apparatus as set forth in claim 17, wherein:
said strip material comprises spring metal; and
said means for causing said end of said strip material to move toward said proximity switch comprises the inherent resiliency of said springy metal.

19. Apparatus as set forth in claim 17, wherein:
said strip material comprises magnetic material; and
said means for causing said end of said strip material to move toward said proximity switch comprises magnet means disposed within said detector assembly.

20. Apparatus set forth in claim 17, wherein:
said frame roller and said support assembly wheel means both engage the outer peripheral surface of said coil of strip material; and
said detector assembly is interposed between said frame roller and said support assembly wheel means with said wheel means disposed upstream of said detector assembly while said frame roller is disposed downstream of said detector assembly as considered in the direction of winding of said coil of strip material.

* * * * *